United States Patent [19]

Robertson

[11] Patent Number: 4,870,900

[45] Date of Patent: Oct. 3, 1989

[54] COMBINED BEARER WIPER ASSEMBLY AND FINGER GUARD FOR PRINTING APPARATUS

[75] Inventor: Albert W. Robertson, Christopher, Ill.

[73] Assignee: Air Stamping, Inc., Christopher, Ill.

[21] Appl. No.: 258,014

[22] Filed: Oct. 14, 1988

Related U.S. Application Data

[63] Continuation-in-part of Ser. No. 118,659, Nov. 9, 1987, which is a continuation of Ser. No. 827,755, Feb. 7, 1986, Pat. No. 4,704,964.

[51] Int. Cl.[4] ..... B41F 5/00; B41F 35/02

[52] U.S. Cl. ..... 101/216; 101/425

[58] Field of Search ..... 101/216, 425, 424, 423; 15/256.51

[56] References Cited

U.S. PATENT DOCUMENTS

| | | | |
|---|---|---|---|
| 1,803,066 | 4/1931 | MacCafferty | 101/216 |
| 3,898,929 | 8/1975 | Arild et al. | 101/425 X |
| 4,704,964 | 11/1987 | Robertson | 101/425 |
| 4,765,240 | 8/1988 | Kraus et al. | 101/216 |

*Primary Examiner*—Clifford D. Crowder

*Attorney, Agent, or Firm*—Cohn, Powell & Hind

[57] ABSTRACT

A wiper assembly (1) for a printing apparatus comprises a finger bar (19) extending longitudinally of printing rolls (5, 7) in a spaced relation thereto at the point of contact between the rolls. Pneumatic rams (33, 35) are attached to respective ends of the finger bar adjacent the bearer members (9, 11, 13, 15) on the rolls. Wiper pads (53, 55) are attached to the ends of each ram and engage the roll bearers. A compressed air supply (81) activates the rams to move the wiper pads into and out of contact with the bearers.

11 Claims, 1 Drawing Sheet

COMBINED BEARER WIPER ASSEMBLY AND FINGER GUARD FOR PRINTING APPARATUS

This is a c-i-p of Ser. No. 118,659 filed on Nov. 9, 1987, which is a continuation of Ser. No. 827,755 filed Feb. 7, 1986 now U.S. Pat. No. 4,704,964 issued Nov. 10, 1987.

BACKGROUND OF THE INVENTION

This invention relates generally to wiper assemblies for the bearers of printing press rolls and more particularly to a wiper assembly utilizing the finger bar guard, positioned adjacent the rollers at their point of contact.

This application relates to U.S. Pat. No. 4,704,964 issued Nov. 10, 1987 and assigned to the same assignee as the current application. This application also relates to continuation patent application Ser. No. 118,659 filed Nov. 9, 1987 and also assigned to the same assignee as the current application.

U.S. Pat. No. 4,704,964 describes a bearer wiper assembly having independently extensible arms in the form of pneumatic rams. Two such rams are mounted on a bracket on either side of a pair of printing press rolls, each roll having a bearer at each end. Each ram has an associated wiper pad which is moved into and out of engagement with the roll bearers to remove foreign particulate matter which collects on the bearers.

While the above described invention works satisfactorily, accessibility to the rams to replace the wiper pads is not always easy. Even though the wiper assembly can be swung away out of engagement with the bearers to permit rapid replacement of the wiper pads, the operator still must work in and around the press which may not always be simple to do. Also, other routine maintenance may not be easily performed due to accessibility. Finally, the number of rams utilized impacts the maintenance cycle since one is required for each wiper.

What would be additionally useful is a bearer wiper assembly which functions essentially in the same manner as that described in U.S. Pat. No. 4,704,964, and the continuation application, with all the advantages thereof; but, which though similar in design has fewer operating parts and is also readily removable from the printing press, easily transported to a work area where the wiper pads can be replaced and other maintenance performed and then returned to the press and quickly reinstalled.

The present bearer wiper assembly solves this and other problems in a manner not revealed in the known prior art.

SUMMARY OF THE INVENTION

The present invention provides a bearer wiper assembly which is easily installed and easily removed from a printing press. In addition, this bearer wiper assembly is transportable so the assembly can be readily moved to a work area for wiper replacement or other routine maintenance. Further, this bearer wiper assembly, when installed, can be readily moved into and out of engagement with the bearer both during operation of the press and when the press is at rest. Also, this bearer wiper assembly has fewer moving parts than earlier assemblies of the same basic type. Finally, this bearer wiper assembly acts to protect operators from getting their fingers, articles of clothing, tools, etc. caught between the press rolls. Other objects and features will be in part apparent and in part pointed out hereinafter.

It is an important aspect of this invention to provide a bearer wiper assembly comprising guard means extending longitudinally of the rolls in a spaced relation thereto at the point of contact between the rolls to prevent an operator's fingers, and other articles from being drawn therebetween; a first ram means attached to one end of the guard means and a second ram means attached to the opposite end thereof, each ram means being located adjacent an associated bearer member on the rolls and each ram means including a piston means and a cylinder means, one of said means being connected to the guard means and the other of said means being movable relative to said guard means; bearer-engageable wiper means attached to said movable means; and actuation means for the ram means to move the wiper means into and out of engagement with the bearers.

It is an aspect of this invention to provide that the piston means is connected to the guard means and that the cylinder means is movable relative to said guard means and said wiper means is attached to said cylinder means.

Still another aspect of this invention is to provide that each wiper means includes a first removable wiper pad for engaging the bearer member on the upper roll and a second removable wiper pad for engaging the bearer member on the lower roll.

Yet another aspect of this invention is to provide that the assembly further includes a generally U-shaped wiper pad mounting bracket affixed to each cylinder means.

Another aspect of this invention is to provide that the wiper means includes clamping means for securing a wiper pad to each arm of the mounting bracket.

It is an aspect of this invention to provide that said first and second ram means are pneumatically operated and are connected by a flexible conduit for simultaneous operation.

It is yet another aspect of this invention to provide that the guard means includes finger bar formed from a generally square bar having a forward corner directed between said rolls, said corner being cut away and grooved to provide an elongate recess receiving at least a portion of said flexible conduit.

It is still another aspect of this invention to provide that the finger bar includes transverse passages therethrough at each end communicating with the ends of said elongate recess and receiving the flexible conduit connected to said first and second ram means.

It is an aspect of this invention to provide support means including first and second side supports respectively positioned outboard of the ends of the rolls, each support having a pocket for receiving an end of the finger bar, and to provide first and second pins are secured to the respective ends of the finger bar and extend longitudinally, outwardly therefrom with the outer ends of the pins being respectively received in the pockets in the side supports, one of said pins being spring-loaded.

An aspect of this invention is to provide that the finger bar includes handle means attached to the bar intermediate its length for installing and removing the finger bar and wiper means and the wiper means carried thereon.

It is an aspect of this invention to provide a bearer wiper assembly which is relatively easy and inexpensive to manufacture, simple to install and effective in operation.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
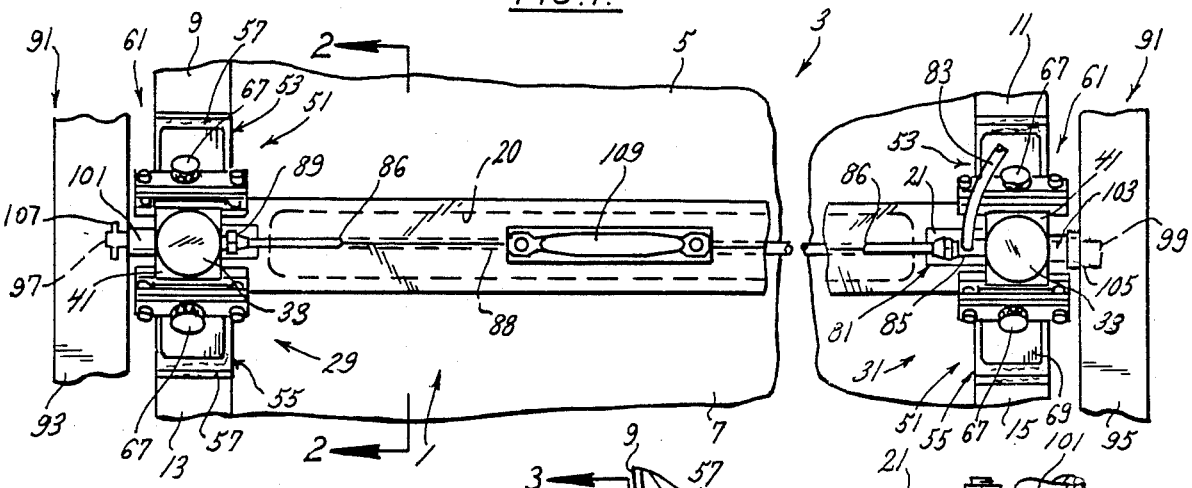
FIG. 1 is a fragmentary elevational view of a bearer wiper assembly of the present invention.
Figure 1:
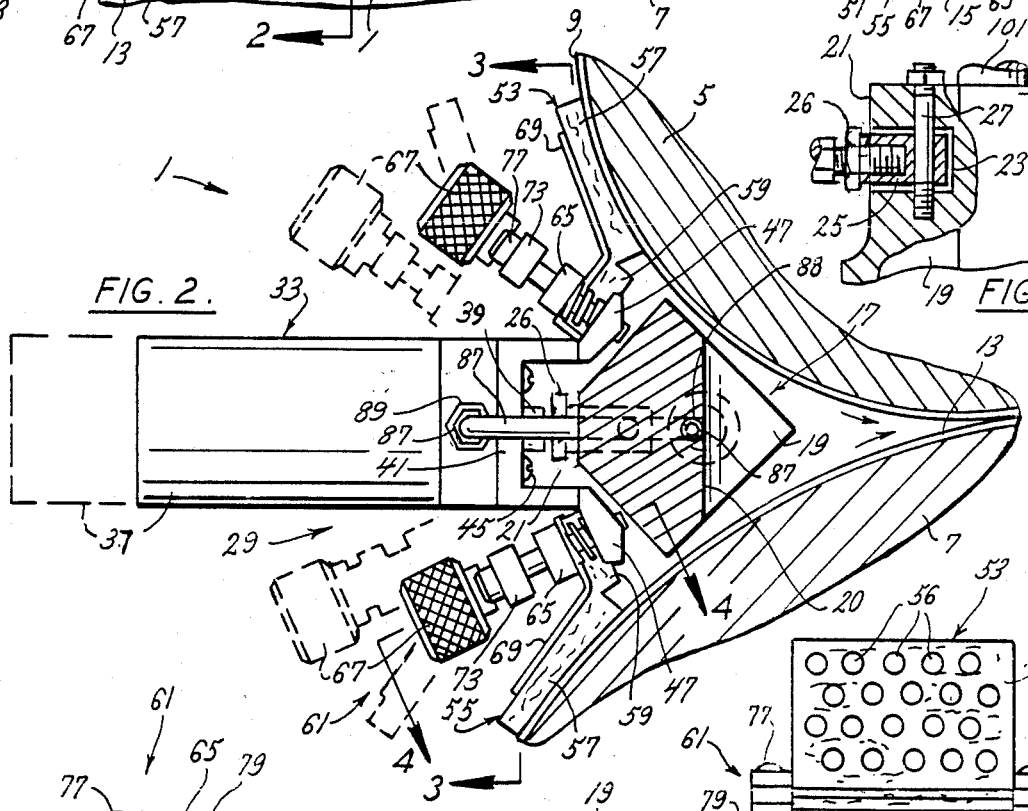
Figure 2:
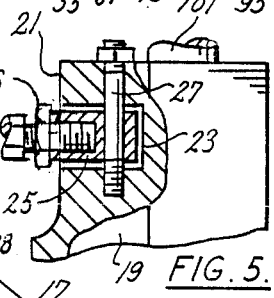
FIG. 2 is a sectional view taken along lines 2—2 in FIG. 1.

Referring now by reference numerals to the drawing, and first to FIGS. 1 and 2, a bearer wiper assembly of the present invention is indicated generally as numeral 1 in FIG. 1. The bearer assembly is used with a printing apparatus 3 that has upper and lower printing rolls, 5 and 7 respectively. The rolls have substantially fixed parallel axes of rotation (the direction of rotation of each roll being indicated by the arrows in FIG. 2). Each roll is provided, at each end, with a cylindrical bearer; roll 5 having bearers 9 and 11, and roll 7 having bearers 13 and 15.

Figure 5:
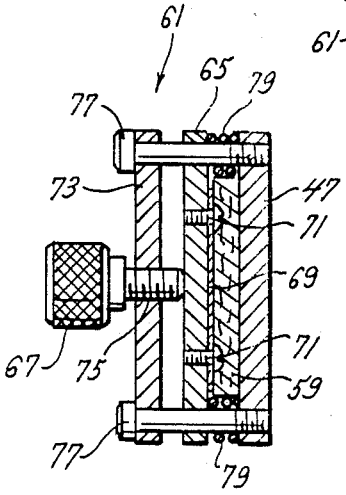
FIG. 5 is a fragmentary plan view of the end of the finger bar.

As shown in the drawings, assembly 1 includes a guard means 17 extending longitudinally of rolls 5 and 7 in a spaced relation thereto at the point of contact between the rolls. Referring to FIG. 2, the guard means, which comprises a finger bar 19 of generally square or diamond shaped configuration, is positioned between the rolls 5 and 7 so there is adequate clearance between the finger bar and the rolls such that the guard means does not interfere with operation of the press. At the same time, the spacing between the finger bar and the rolls is so narrow that an operator's hand or fingers, articles of clothing or tools cannot be pulled between the rolls. The inner, intermediate portion of the bar 19 is truncated to provide a recess 20. The outer end portions of the bar (as viewed in FIG. 2) are truncated as indicated to provide mounting flats 21, bored as indicated at 23. The finger bar 19 is provided at each end with a bored hole 23 which receives internally threaded adaptors 25 in somewhat loose relationship, each of said adaptors 25 being transversely apertured to receive a pivot pin 27 received in an opening provided in the end of the finger bar 19 as shown in FIG. 5.

Bearer engageable wiper means 29 and 31 respectively are mounted to each end of the finger bar 19. The bearer wiper means are essentially identical and will therefore be described with respect to means 29.

Bearer wiper means 29 is attached to the end of the finger bar 19 by a pneumatic ram means 33 consisting of a cylinder 37 and a piston 39 which is hexagonal to prevent rotation. The piston 39 is threaded at its remote end and is received within the adaptor 25 and locked in place in said adaptor by lock nut 26 so that the adaptor is effectively an extension of the piston 39 which, accordingly, is pivotally pin connected to the finger bar 19. This structural arrangement of parts provides that the piston 39 remains substantially stationary with respect to the finger bar 19 while the cylinder 37 is movable perpendicularly fore and aft with respect to the longitudinal axis of the finger bar.

A U-shaped bracket 41 is fixedly attached to the end of each cylinder 37 by means of screws 45 extending through the bight portion 43. The arms of the bracket 41 include oppositely inclined flared end portions 47, to each of which is attached a wiper unit 51 which includes a removable ell-shaped wiper pad 53 engageable with an associated upper and lower bearer 9 or 13 respectively. The ell-shaped wiper pad includes a longer arm 57 and a shorter arm 59; the longer arm 57 is provided with a plurality of collection openings 56 and the shorter arm 59 is clamped to the bracket 41 as will now be described.

Figure 4:
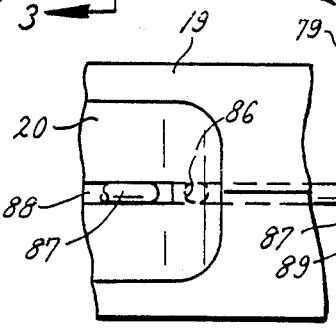
FIGS. 3 and 4 are sectional views taken along lines 3—3 and 4—4 respectively in FIG. 2.
Figure 3:
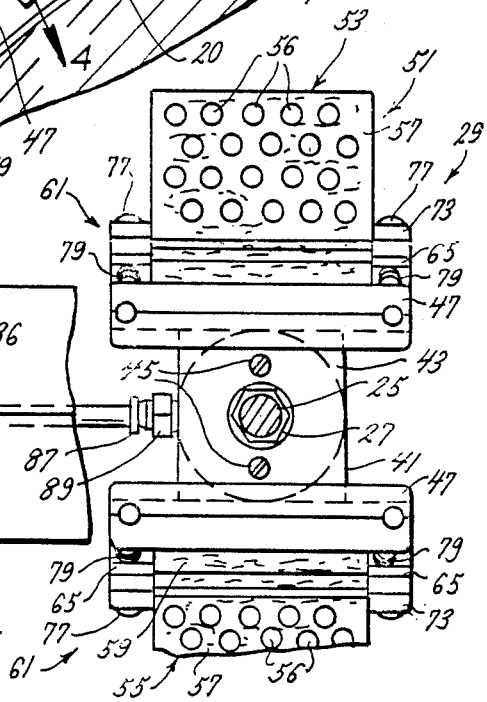

As shown in FIGS. 3 and 4 each wiper unit 51 includes a clamping frame 61 including a clamping member 65, having an ell-shaped backing plate 69 attached thereto as by screws 71, and a cooperating cross member 73. Cross member 73 and clamping plate 65 are apertured to receive guide bolts 77 which are threadedly connected to flared end portions 47 and are provided with an associated compression spring 79. Cross member 73 includes a central aperture 75 threaded to receive a clamping screw 67 engageable with clamping plate 65.

To remove a pad, screw 67 is backed off so the pad can be pulled from between the backing plate and the bracket arm. When a new pad is installed, the screw is turned to press plate 65 against the pad and sandwich the pad between the bracket arm and the backing plate.

Bearer wiper assembly 1 next includes actuation means 81 for moving the pistons 39 in their respective cylinders 37 to move the wiper units 51 into and out of contact with their associated bearers. Actuation means 81 is pneumatic and includes a compressed air supply line 83 which communicates between a source of compressed air (not shown) and a T-connection nipple 85 which connects to the cylinder of the second bearer wiper means 31. A second air supply line 87 extends between nipple 85 and a nipple 89 which connects to a cylinder of the first bearer wiper means 29 for simultaneous operation of the wiper means 29. As shown in FIGS. 1, 2 and 3, line 87 runs a short distance along the outside of finger bar 19, then is directed by virtue of a transverse passage 86 to the underside of the bar where it runs in a longitudinal groove 88 provided in recess 20 almost to the opposite end of the bar, at which point it is again directed to the outside of the bar by another transverse passage 86 for connection to the nipple of the other cylinder.

Operation of the wiper assembly is similar to that of the assembly described in U.S. Pat. No. 4,704,964 which is incorporated herein by reference. Essentially, the turning on and shutting off of the compressed air supply to the two cylinder means moves the wipers from their position contacting the bearers (the solid line position shown in FIG. 2) to their position at which they are out of contact with the bearers (the dashed line portion in FIG. 2).

To facilitate replacement of the wiper pads and other routine maintenance on the assembly, the assembly includes support means 91 to which the finger bar 19 is releasably attached. Support means 91 includes first and second side supports, 93 and 95 respectively, positioned outboard of the ends of rolls 5 and 7, each bracket having a pocket or recess, 97 and 99 respectively, for receiving an end of the finger bar. As shown in FIG. 1, a first pin 101 is secured to the left end of bar 19 and a second pin 103 is secured to the other end of the bar. Both pins extend longitudinally outwardly from the ends of the bar. Pin 103 is received in pocket 99 of support 95 and the pin has a supporting collar 105. The other pin, 101, has a locking pin 107 extending transversely thereof and pocket 97 has a keyway (not shown) in which the pin 107 is inserted whereby, after insertion, rotation of the pin in the pocket will lock the assembly in place. Pin 103 is adjustable as to the distance it extends beyond the ends of bar 19 by virtue of being spring-loaded which facilitates installation and removal of the assembly.

Lastly, assembly 1 includes a handle 109 to facilitate installation, removal, and handling of the assembly. The assembly can have more than one such handle, and preferably two handles are provided spaced symmetrically on the finger bar 19.

In view of the above, it will be seen that various aspects and features of the invention are achieved and other advantageous results attained. While a preferred embodiment of the invention has been shown and described, it will be clear to those skilled in the art that various modifications may be made without departure from the invention in its broader aspect.

I claim as my invention:

1. In a printing apparatus having upper and lower printing rolls for which rotatable bearer members are provided at the respective ends thereof, a bearer wiper assembly comprising:

(a) guard means extending longitudinally of the rolls in a spaced relation thereto at the point of contact between the rolls to prevent an operator's fingers, and other articles from being drawn therebetween;

(b) a first ram means attached to one end of the guard means and a second ram means attached to the opposite end thereof, each ram means being located adjacent an associated bearer member on the rolls and each ram means including a piston means and a cylinder means, one of said means being connected to the guard means and the other of said means being movable relative to said guard means;

(c) bearer-engageable wiper means attached to said movable means; and (d) actuation means for the ram means to move the wiper means into and out of engagement with the bearers.

2. The assembly of claim 1, in which:

(e) the piston means is connected to the guard means and the cylinder means is movable relative to said guard means and said wiper means is attached to said cylinder means.

3. The assembly of claim 2 wherein:

(f) each wiper means includes a first removable wiper pad for engaging the bearer member on the upper roll and a second removable wiper pad for engaging the bearer member on the lower roll.

4. The assembly of claim 3 wherein:

(g) the assembly further includes a generally U-shaped wiper pad mounting bracket affixed to each cylinder means.

5. The assembly of claim 4, wherein:

(h) the wiper means includes clamping means for securing a wiper pad to each arm of the mounting bracket.

6. The assembly of claim 1, wherein:

(e) said first and second ram means are pneumatically operated and are connected by a flexible conduit for simultaneous operation.

7. The assembly of claim 6, in which:

(f) the guard means includes a finger bar formed from a generally square bar having a forward corner directed between said rolls, said corner being cut away and grooved to provide an elongate recess receiving at least a portion of said flexible conduit.

8. The assembly of claim 7, wherein:

(g) the finger bar includes transverse passages therethrough at each end communicating with the ends of said elongate recess and receiving the flexible conduit connected to said first and second ram means.

9. The assembly of claim 6, wherein:

(f) support means is provided including first and second side supports respectively positioned outboard of the ends of the rolls, each support having a pocket for receiving an end of the finger bar, and (g) first and second pins are secured to the respective ends of the finger bar and extend longitudinally, outwardly therefrom with the outer ends of the pins being respectively received in the pockets in the side supports, one of said pins being spring-loaded.

10. The assembly of claim 9 wherein:

(h) the finger bar includes handle means attached to the bar intermediate its length for installing and removing the finger bar and wiper means.

11. The assembly of claim 1, wherein:

(e) the guard means includes a removable finger bar.

* * * * *